United States Patent [19]

Widham

[11] 4,344,559

[45] Aug. 17, 1982

[54] SIGNAL DEVICES FOR RURAL MAILBOXES

[76] Inventor: Ernest G. Widham, 145 Great Neck Rd., Waterford, Conn. 06385

[21] Appl. No.: 194,138

[22] Filed: Oct. 6, 1980

[51] Int. Cl.[3] ..... B65B 91/00

[52] U.S. Cl. ..... 232/35

[58] Field of Search ..... 232/34, 35

[56] References Cited

U.S. PATENT DOCUMENTS

| | | | |
|---|---|---|---|
| 2,856,123 | 10/1958 | Mary | 232/35 |
| 3,017,073 | 1/1962 | Piergiovanni | 232/35 |
| 3,212,701 | 10/1965 | Smith | 232/35 |
| 3,229,903 | 1/1966 | Smith | 232/35 |
| 3,498,256 | 3/1970 | Hebal | 232/34 X |
| 3,709,189 | 1/1973 | Widham | 232/35 X |
| 3,891,139 | 6/1975 | Redling | 232/35 |

*Primary Examiner*—Roy D. Frazier
*Assistant Examiner*—Peter A. Aschenbrenner
*Attorney, Agent, or Firm*—Walter Spruegel

[57] ABSTRACT

Mailbox has a hinged front gate with a casing receiving a flag with lateral play for movement into raised and lowered positions to indicate "no mail" and "mail delivery", respectively. Provided on the flag and box are two ferromagnetic strips, respectively, of which at least one is a permanent magnet, with these strips being coordinated to be in the raised flag position in magnetic engagement for supporting the flag, and the strip on the flag will on opening of the gate turn with the latter and thereby disengage from the strip on the box for release of the flag for its gravitational drop to its lowered position.

4 Claims, 9 Drawing Figures

SIGNAL DEVICES FOR RURAL MAILBOXES

This invention relates to mailboxes in general, and to signal devices for rural mailboxes in particular.

The present invention deals with a mailbox of a type which is characterized by a signal flag and a hinged front gate with a casing in which the flag is received with some lateral play for a gravitational drop with its bottom edge leading from a raised position into a lowered position on opening the gate for delivering mail to the box, and thereby indicating a mail delivery. A mailbox of this type is shown in my prior U.S. Pat. No. 3,709,189, and the same is also provided with non-magnetic holding means for the flag in its raised position.

It is an important object of the present invention to provide a mailbox of this type which, in lieu of the aforementioned non-magnetic flag-holding means, features magnetic flag holding means. To this end, the magnetic flag-holding means provide a pair of ferromagnetic companion strips of which at least one strip is a permanent magnet, and both strips are provided on the flag and on the box, in one coordination such that the strips are in the raised flag position in substantial optimum magnetic coupled relation with each other for solely supporting the flag, and in further coordination such that on opening the gate the strip on the flag, then turning with the gate, will turn on the strip on the box as a fulcrum and thus gradually weaken and finally break the magnetic bond between them for release of the flag for its gravitational drop to its lowered position.

It is another object of the present invention to provide a mailbox of this type with the aforementioned magnetic flag holding means, of which the gate is hinged to the bottom of the box, and the ferromagnetic strips are in their aforementioned further coordination so arranged that the strip on the box is spaced forwardly and upwardly from the hinge axis of the gate, and this same strip also extends in an upright plane. The casing and the flag are preferably shorter than the gate, and the casing may be in the form of a pocket on the gate which is closed except at the bottom for clearance thereat of the flag in its extent therethrough.

It is a further object of the present invention to provide a mailbox of this type with the aforementioned magnetic flag-holding means of which the magnetic strip on the box extends in a plane which extends at an inclination upwardly and rearwardly of the box, thereby holding the flag with increased magnetic force in its raised position until released for its gravitational drop to its lowered position.

It is still another object of the present invention to provide a mailbox of this type with the aforementioned magnetic flag holding means, of which the flag is in its raised position resting with a shoulder on a she LF on the box which then assumes the sole support of the flag, and on opening the box the flag will with its shoulder be retracted from the shelf until clearing the same for its gravitational drop to its lowered position.

Further objects and advantages will appear to those skilled in the art from the following, considered in conjunction with the accompanying drawings.

In the accompanying drawings, in which certain modes of carrying out the present invention are shown for illustrative purposes:

Figures 1, 2, 3, 4, 5, 6, 7, 8, 9:
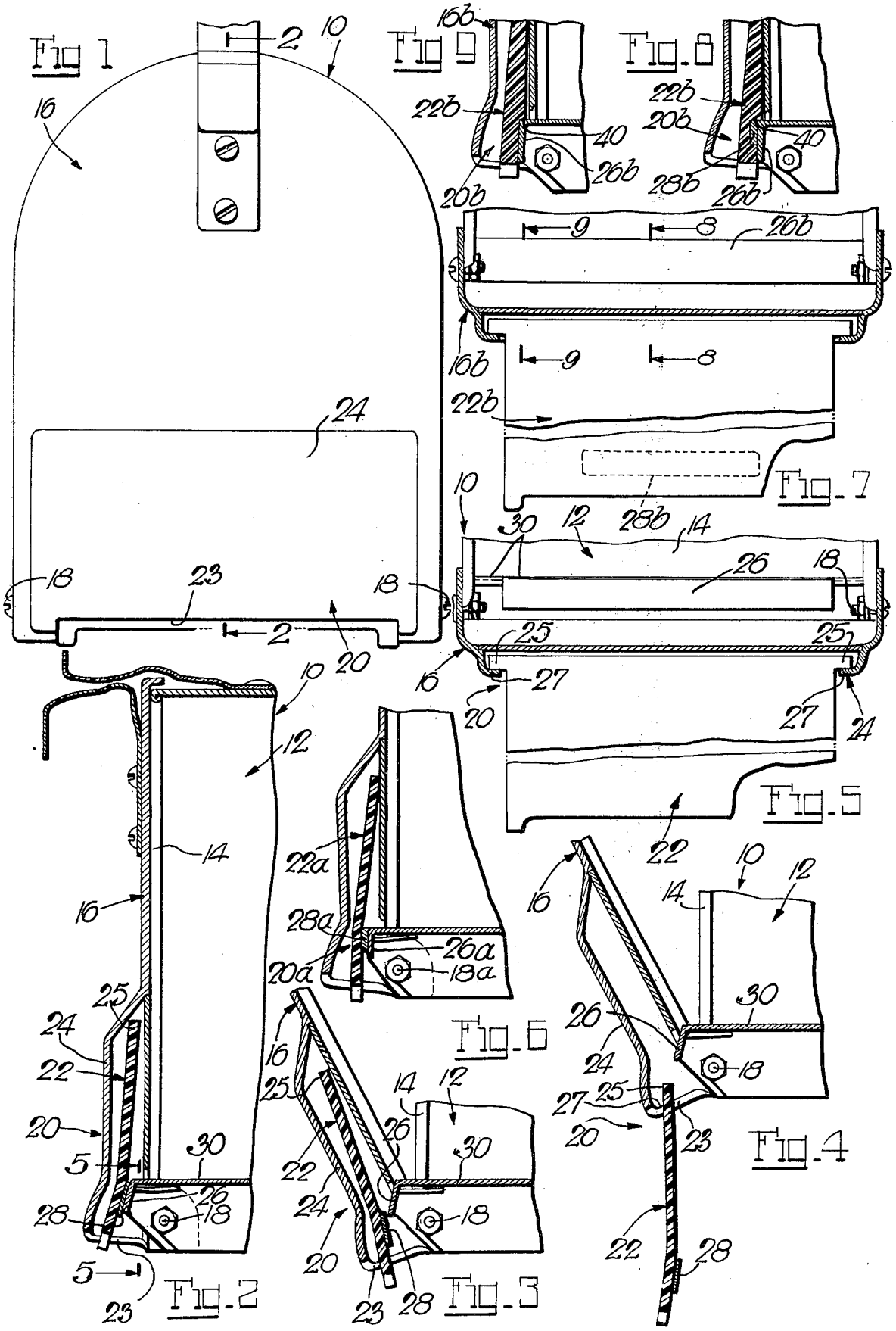
FIG. 1 is a front view of a mailbox embodying the invention.
FIG. 2 is a transverse section through the mailbox taken substantially on the line 2—2 of FIG. 1.
FIGS. 3 and 4 are fragmentary sections through the mailbox of FIG. 2 in different operating conditions.
FIG. 5 is a fragmentary section through the same mailbox taken substantially on the line 5—5 of FIG. 2.
FIG. 6 is a fragmentary section through a mailbox embodying the invention in a modified manner.

FIG. 7 is a fragmentary section through a mailbox embodying the invention in a further modified manner; and FIGS. 8 and 9 are fragmentary sections through the mailbox of FIG. 7 as taken on the lines 8—8 and 9—9, respectively, of FIG. 7.

Referring to the drawings, and more particularly to FIGS. 1 to 5 thereof, the reference numeral 10 designates a mailbox of typical rural type, having the usual delivery box 12 with its open front 14 and a gate 16 to open and close the latter. The gate 16 is at its bottom hinged at 18 to opposite sides of the box 12.

The present mailbox is provided with a signal device 20 to signify whether mail has or has not been delivered to the box, with the primary element of this device being a signal flag 22 which is carried in a casing 24 on the gate 16 and operable into two different positions, namely a raised position to signify "no mail delivery", and a lowered position to signify "mail delivery" (FIGS. 4 and 5). The flag 22 is held in its raised position magnetically in a manner to be described, and is released from its raised position for a gravitational drop to its lowered position (FIG. 4) in which it projects through a bottom slot 23 in the casing 24 and is held by opposite side ears 25 which come to rest on shoulders 27 on opposite sides of the bottom slot 23 in the casing 24. The signal device 20 is of featured magnetic type, with the box 12 and signal flag 22 being to this end provided with companion ferromagnetic strips 26 and 28 of which at least one strip, in this instance strip 28, is a permanent magnet. The ferromagnetic strip 26 on the box is conveniently formed as a flange-like projection of the sheet-metal bottomwall 30 at its front end. The other, permanent-magnet strip 28 is suitably secured, as by cementing, for example, to the signal flag 22 which is of non-magnetic material such as plastic. Of course, the strips 26 and 28 are coordinated to be in magnetically coupled relation in the raised flag position (FIG. 2). The flag 22 is in this instance dimensioned longitudinally so as to be substantially hidden from view in the casing 24 when in its raised position. The flag 22 is thus held in its raised "no mail" indicating position for the relatively long intervals between mail pick-up and next mail delivery during which the signal device with the hidden flag is not liable to be vandalized by passing youngsters. Further, the signal device, and particularly the operating parts 26 and 28 are effectively protected from the ravashing effects of the elements when the flag is in its raised position.

In opening the gate 16, the flag 22 will be turned with the gate 16 and casing 24 relative to the stationary magnetic strip 26 on the box 12, whereby due to further coordination of the strips 26 and 28 the latter will at the beginning of such turning movement of the flag remain magnetically coupled, with the result that the magnetic strip 28 on the flag will then merely turn on the stationary magnetic strip 26 as a fulcrum until the magnetic bond between them becomes too weak and breaks, thereby releasing the flag for gravitational descent toward and into its lowered position (FIGS. 3 and 4).

For such further coordination of the magnetic strips 26 and 28 for their explained featured separation on opening the gate, the stationary strip 26 is spaced forwardly and upwardly from the hinge axis of the gate. Thus, while the magnetic forces of the companion strips 26,28 may be rather strong for holding the weight of the flag up in its raised position for the longest time, the featured fulcrum-like operational separation of the strips 26,28 on opening the gate will unfailingly break the magnetic bond between them for the equally unfailing gravitational drop of the flag to its lowered position. With the flag 22 being exposed to view in its lowered position and therby indicting a mail delivery, the one picking up the mail will walk to the box and open the gate 16 to reach for the mail. Of course, having once removed the mail from the box, it is merely necessary to cast the lowered flag 22 in a brief shove upwardly and therby return the same to its raised position and restore the strips to their strong magnetic coupling.

It will also be noted that the stationary magnetic strip 26 is planewise inclined upwardly and rearwardly (FIG. 2) wherefore the magnetic strips 26 and 28 hold up the flag with a force which is greater than the force exerted on the flag 22*a* by the magnetic strips 26*a*,28*a* in the modified signal device 20*a* of FIG. 6 in which the stationary magnetic strip 26*a* extends planewise vertically rather than inclined as in FIG. 2. Thus, the magnetic flag-holding forces between the inclined magnetic strips 26,28 in FIG. 2 have vertical supporting vectors which the magnetic flag holding forces between the vertical magnetic strips 26*a*,28*a* of FIG. 6 do not have.

Finally, FIGS. 7 to 9 show a mailbox with a further modified signal device 20*b* in which the flag 22*b* is positively supported in its raised position. To this end, the flag 22*b* has along the top of the magnetic strip 28*b* a shoulder 40 which in the raised position of the flag rests on top of the stationary magnetic strip 26*b* (FIGS. 8 and 9). However, on opening the gate 16*b*, the flag 22*b* will turn with the latter whereby the shoulder 40 on the flag will be retracted from and clear the top of the magnetic strip 26*b* and thereby release the flag for its gravitational drop to its lowered position. In subsequently raising the flag, the same will with its shoulder 40 snap over the top of the magnetic strip 26*b* when the flag reaches the proper height.

What is claimed is:

1. In a mailbox, the combination with a box having a bottom and front end; a gate hinged at its bottom to the bottom of the box and provided with a longitudinal casing having a bottom with an aperture and opposite shoulders; a longitudinal signal flag having opposite side ears at the top and being received in said casing with lateral play and for longitudinal movement into raised and lowered positions, with said flag in its raised position being retracted in said casing, and in said lowered position being with its ears suspended from said shoulders and gravitating through said aperture; a pair of ferromagnetic strips of which at least a certain strip is a permenant magnet, with said strips being carried by said flag and by the bottom of said box at said front end, respectively, and so coordinated that the strip on the box extends in an upright plane and is in substantial planar magnetic engagement with the other strip on said flag in said raised position, and said strip on the box is further spaced forwardly and upwardly from the hinge axis of the gate so that on opening the latter the strip on the flag will turn on the other strip as a fulcrum and thus gradually weaken and finally break the magnetic bond between them for release of the flag for its gravitational drop to its lowered position.

2. The combination in a mailbox as in claim 1, in which the strip on the box extends in a vertical plane.

3. The combination in a mailbox as in claim 1, in which the strip on the box extends in a plane inclined forwardly and downwardly.

4. The combination in a mailbox as in claim 1, in which said flag is non-magnetic and has a shoulder resting on top of the strip on the box in said raised flag position on the closed gate, with said shoulder being of a width to clear the strip on the box on partially opening the gate.

* * * * *